US008744300B2

(12) United States Patent
Lee

(10) Patent No.: US 8,744,300 B2
(45) Date of Patent: Jun. 3, 2014

(54) IMAGE FORMING APPARATUS

(75) Inventor: Jung Jae Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 620 days.

(21) Appl. No.: 12/624,114

(22) Filed: Nov. 23, 2009

(65) Prior Publication Data

US 2010/0189460 A1 Jul. 29, 2010

(30) Foreign Application Priority Data

Jan. 23, 2009 (KR) ..... 10-2009-0006219

(51) Int. Cl.
*G03G 15/00* (2006.01)

(52) U.S. Cl.
USPC ..... 399/90; 399/111

(58) Field of Classification Search
USPC ..... 399/110, 111, 113, 119, 90
See application file for complete search history.

(56) References Cited

U.S. PATENT DOCUMENTS 6,097,908 A * 8/2000 Uchiyama et al. ..... 399/111
6,892,039 B2 * 5/2005 Okamoto et al. ..... 399/90
2002/0118984 A1 * 8/2002 Lee et al. ..... 399/330
2005/0214018 A1 * 9/2005 Hale et al. ..... 399/90
2008/0226331 A1 * 9/2008 Allen et al. ..... 399/90

FOREIGN PATENT DOCUMENTS

JP 2000-293056 10/2000

OTHER PUBLICATIONS

English language abstract of JP 2000-293056, published Oct. 20, 2000.
Machine English language translation of JP 2000-293056, published Oct. 20, 2000.

* cited by examiner

*Primary Examiner* — Walter L Lindsay, Jr.
*Assistant Examiner* — Jessica L Eley
(74) *Attorney, Agent, or Firm* — Staas & Halsey LLP

(57) ABSTRACT

Disclosed is an image forming apparatus with improved electrical connections. The image forming apparatus may includes a main body into which a device is detachably received. The electrical terminals provided in the main body connected correspondingly with electrical contact points provided on the detachable device. One or more surface distance extension parts may be arranged surrounding respectively one or more terminals such that the surface distance between two adjacent terminals can be increased. The detachable device may be, for example, a developing unit assembly, which may include one or more of a photoconductor, a charging device for charging the photoconductor to an electrical potential and a developer supply unit for supplying developer to the photoconductor.

20 Claims, 9 Drawing Sheets

IMAGE FORMING APPARATUS

CROSS-REFERENCE TO RELATED APPLICATION

This application claims the benefit of Korean Patent Application No. 10-2009-0006219, filed on Jan. 23, 2009 in the Korean Intellectual Property Office, the disclosure of which is incorporated herein by reference.

TECHNICAL FIELD

The present disclosure relates generally to an image forming apparatus with an improved electrical connection configuration.

BACKGROUND OF RELATED ART

Image forming apparatuses are apparatuses that form an image on printing media, e.g., sheets of paper, according to an input image signal, examples of which may include a printer, a copier, a fax machine and a multi-function peripheral that combines some of the functionalities of the afore-mentioned.

For example, an electro-photographic image forming apparatus refers to a type of image forming apparatus that forms an electrostatic latent image on the surface of a photoconductor that had been charged to a predetermined electrical potential by irradiating light onto the photoconductor, and that forms a visible image using a developer supply unit to supply developer, e.g., toner, to the electrostatic latent image. The visible image formed on the photoconductor may be transferred directly onto a sheet of paper or may be transferred to the paper via an interim transfer unit. The image transferred to the paper is then fixed to the paper through a fusing process.

Such an image forming apparatus typically includes a number of electrical contact points of various shapes and types, to some of which a high voltage of about 1 kV or more may be applied. These contact points may be arranged to maintain certain distances from one another to ensure safety and/or for efficiency considerations. Unfortunately, such distances necessary between the contact points may however serve as obstacles to a size reduction of the image forming apparatus.

SUMMARY OF DISCLOSURE

In accordance with one aspect of the present disclosure, an image forming apparatus may include a main body, one or more developing unit assemblies, one or more terminals and a surface distance extension part. The main body may define an overall external appearance of the image forming apparatus. The one or more developing unit assemblies may be detachably received in the main body. Each of the one or more developing unit assemblies may include a photoconductor, a charging device and a developer supply unit. The charging device may be arranged adjacent the photoconductor, and may be configured to charge the photoconductor to an electrical potential. The developer supply unit may be configured to supply developer to the photoconductor. The one or more terminals may be provided on a support surface within the main body, and may be arranged to be electrically connected to one or more electrical contacts of each of the one or more developing unit assemblies received in the main body. The surface distance extension part may have a surface that surrounds at least a portion of any one of the one or more terminals so as to extend a surface distance between at least two adjacent ones of the one or more terminals.

The surface distance extension part may comprise one of a protrusion protruding from the support surface and a depression into the support surface.

The surface distance extension part may be made of a non-conductive material.

The image forming apparatus may further comprise one or more connection plates and one or more connectors. Each of the one or more connection plates may be in electrical connection with a respective corresponding one of the one or more terminals, and may have a first insertion portion at one side thereof. The one or more connectors may each have a second insertion portion capable of being coupled to the first insertion part of a respective corresponding one of the one or more connection plates.

The first insertion portion may comprise a protrusion. The second insertion portion may comprise a recess into which the first insertion portion is received.

The image forming apparatus may further comprise one or more insulating caps each arranged over, and to thereby protect, the first insertion part and the second insertion part, which are coupled to each other, associated with a respective corresponding pair of one or more connection plates and the one or more connectors.

Each of the one or more insulating caps may be arranged slidably on a respective associated one of the one or more connectors.

According to another aspect of the present disclosure, an image forming apparatus having a support plate on which contact points are arranged for applying electrical power therethrough may be provided to include a surface distance extension part arranged on the support plate in such a manner to surround a first one of the contact points so as to extend a surface distance between the first one of the contact points and a second one of the contact points adjacent the first one of the contact points.

The surface distance extension part may comprise a wall protruding from the support plate.

The surface distance extension part may comprise one or more grooves formed into the support plate.

The surface distance extension part may be formed of a non-conductive material.

The image forming apparatus may further comprise connectors, each of which are electrically connected with a respective corresponding one of the contact points. The contact points and the connectors may each comprise one of a protrusion and a recess into which the protrusion is received.

The image forming apparatus may further comprise an insulating cap arranged to cover, and to thereby protect, a coupled pair of contact point and connector.

The insulating cap may be arranged slidably on at least one of the connectors.

According to yet another aspect of the present disclosure, an image forming apparatus may be provided to include a main body, developing unit assemblies, a plurality of contact points, a plurality of terminals and a surface distance extension part. The main body may define an external appearance of the image forming apparatus. The developing unit assemblies may each include a photoconductor, a charging device, a developer reception chamber and a developing device. The charging device may be configured to charge the photoconductor to an electrical potential. The developer reception chamber may be configured to store therein developer to be supplied to the photoconductor. The developing device may be configured to supply the developer stored in the developer reception chamber to the photoconductor. The plurality of contact points may be provided on each of the developing unit assemblies, through which electrical power may be supplied to at least one of the charging device and the developing device. The plurality of terminals may be provided on a support plate within the main body. Each of the plurality of terminals may be configured to be connected with a respective corresponding one of the plurality of contact points provided on each of the developing unit assemblies. The surface distance extension part may be arranged to surround a first one of the plurality of terminals so as to extend the surface distance between the first one of the plurality of terminals and a second one of the plurality of terminals adjacent the first one of the plurality of terminals.

The surface distance extension part may comprise a wall protruding from the support plate.

The surface distance extension part may comprise a groove formed on the support plate.

According to even yet another aspect of the present disclosure, an image forming apparatus may be provided to include a first support member and a surface distance extension. The first support member may have arranged thereon a first plurality of electrical contacts. Two adjacent ones of the first plurality of electrical contacts may be space apart from each other by a first distance. The surface distance extension may be arranged on the first support member to surround at least one of the two adjacent ones of the first plurality of electrical contacts such that a first surface distance measured along surfaces of the first support member and the surface distance extension from one the two adjacent ones of the first plurality of electrical contacts to the other is greater than the first distance by which the two adjacent ones of the first plurality of electrical contacts are spaced apart.

The image forming apparatus may further comprise a second support member having a second plurality of electrical contacts arranged thereon. The second plurality of electrical contacts may be arranged such that each of the second plurality of electrical contacts comes into contact with a respective corresponding one of the first plurality of electrical contacts. A second surface distance measure along the surface of the second support member between two adjacent ones of the second plurality of electrical contacts that correspond respectively to the two adjacent ones of the first plurality of electrical contacts may be smaller than the first surface distance.

The second support member may be detachable from the image forming apparatus.

BRIEF DESCRIPTION OF THE DRAWINGS

Various aspects and features of the present disclosure will become apparent and more readily appreciated from the following description of several embodiments, taken in conjunction with the accompanying drawings, of which.

DETAILED DESCRIPTION OF SEVERAL EMBODIMENTS

Figure 1:
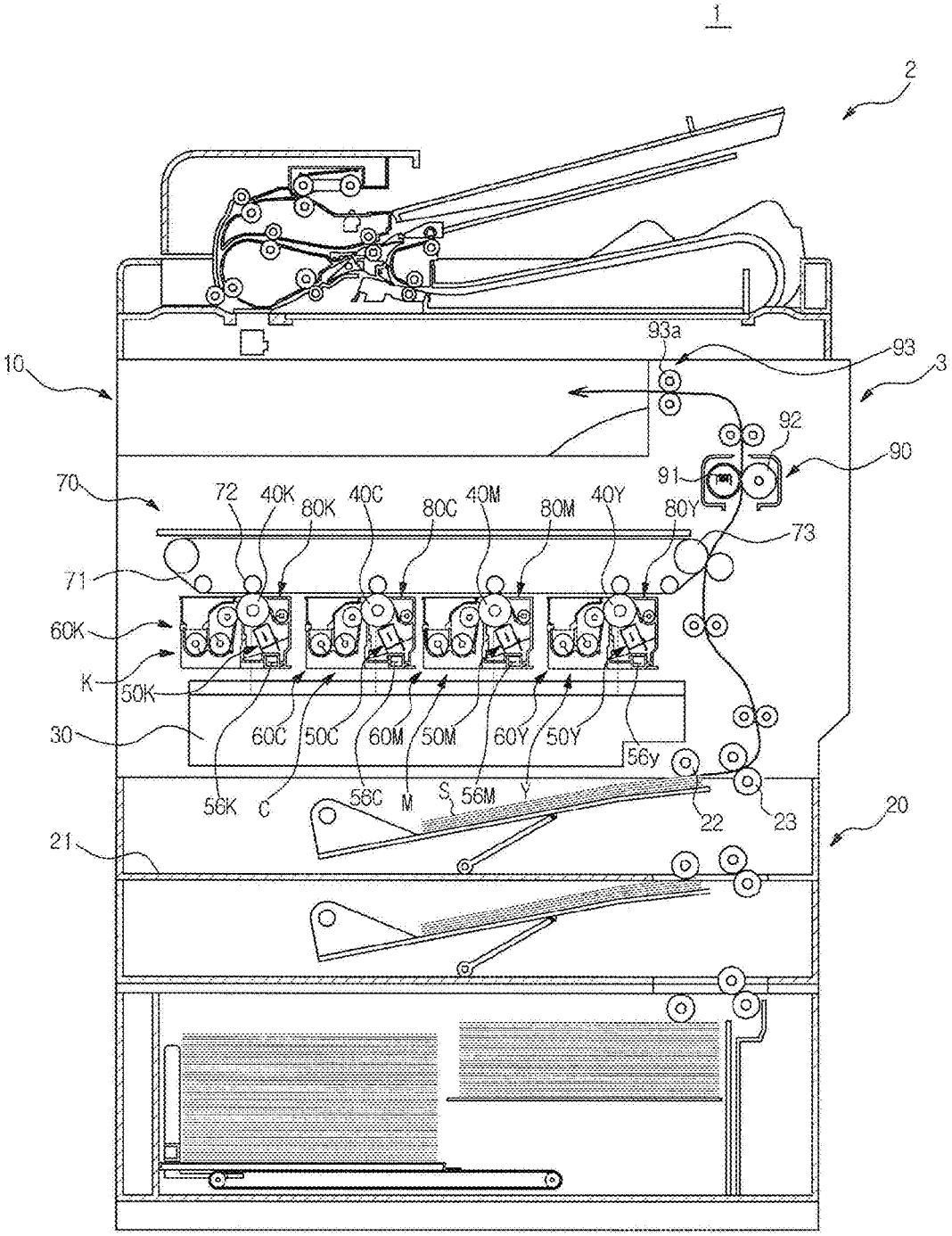
FIG. 1 is a cross-sectional view illustrative of an image forming apparatus in accordance with an embodiment of the present disclosure.

Reference will be made in detail to several embodiments of the present disclosure, examples of which are illustrated in the accompanying drawings, wherein like reference numerals refer to the like elements throughout.

FIG. 1 is a longitudinal-sectional view illustrating an image forming apparatus in accordance with an embodiment of the present disclosure.

As shown in FIG. 1, an image forming apparatus 1 according to an embodiment may include an image reading unit 2 that may be operable to read an image from a document, and a printing device 3 that may be configured to print an image on paper.

The printing device 3 may print the image according to a signal received from the image reading unit 2 or according to a signal input from an external device, such as, for example a personal computer (PC). To that end, the printing device 3 may include a main body 10, a paper supply unit 20, a light scanning unit 30, photoconductors 40K, 40C, 40M and 40Y, charging devices 50K, 50C, 50M and 50Y, developer supply units 60K, 60C, 60M and 60Y, a transfer unit 70, waste developer removal units 80K, 80C, 80M and 80Y, a fusing unit 90 and an exit unit 93.

The main body 10 may defined the overall external appearance of the image forming apparatus 1, and may support various components installed therein.

The paper supply unit 20 may include a cassette 21 for storing therein print media S, a pickup roller 22 configured to pick up the print media S stored in the cassette 21 sheet by sheet and feeding rollers 23 to feed the picked up print media S to the transfer unit 70.

The light scanning unit 30 irradiates light corresponding to image data onto the photoconductors 40K, 40C, 40M and 40Y to respectively form latent images on the surfaces of the photoconductors 40K, 40C, 40M and 40Y.

The photoconductors 40K, 40C, 40M and 40Y may be charged to an electrical potential by the charging devices 50K, 50C, 50M and 50Y prior to being exposed to the light from the light scanning unit 30. The light exposure results in the electrical potential differences between the exposed and non-exposed portions of the surfaces of the photoconductors 40K, 40C, 40M and 40Y to thereby form the latent images of pattern of potential differences. The image forming apparatus according to an embodiment may further includes air suction ducts 56K, 56C, 56M and 56Y for removal of by-products of corona discharge, such as ozone, $NO_x$, etc. It should be noted that, while for purposes of illustration corona type charging devices 50K, 50C, 50M and 50Y are shown in FIG. 1 and in other figures, in alternative embodiments, other types of charging device, for example, roller-type charging devices, may alternatively be employed.

The developer supply units 60K, 60C, 60M and 60Y may supply developer to the respective latent images formed on the corresponding photoconductors 40K, 40C, 40M and 40Y, and may thereby develop the latent images into visible images. For embodiments of the image forming apparatus capable of forming color images, the developer supply units 60K, 60C, 60M and 60Y may contain developer in different colors, for example, black, cyan, magenta, and yellow, respectively.

The transfer unit 70 may includes an interim transfer belt 71, first transfer rollers 72 and a second transfer roller 73. The visible images formed on the photoconductors 40K, 40C, 40M and 40Y may be transferred to the interim transfer belt 71 by the operations of the first transfer rollers 72. The images may then be transferred from the interim transfer belt 71 onto a print medium, e.g., a sheet of paper, which is supplied from the paper supply unit 20 as the print medium passes through the gap between the second transfer roller 73 and the interim transfer belt 71.

The waste developer removal units 80K, 80C, 80M and 80Y may operate to remove from the respective corresponding photoconductors 40K, 40C, 40M and 40Y waste developer that is not transferred to the interim transfer belt 71 and that remains residual on the photo conductors 40K, 40C, 40M and 40Y The fusing unit 90 may include a heating roller 91 and a pressure roller 92. The paper, onto which the images are transferred, is made to pass through a gap between the heating roller 91 and the pressure roller 92. As a result, the images are fused onto the paper by the application of the heat and pressure. The paper having passed through the fusing unit 90 may then be guided to the exit unit 93, where the paper is discharged out of the main body 10 of the printing device 3 by exit rollers 93*a*.

Figure 2:
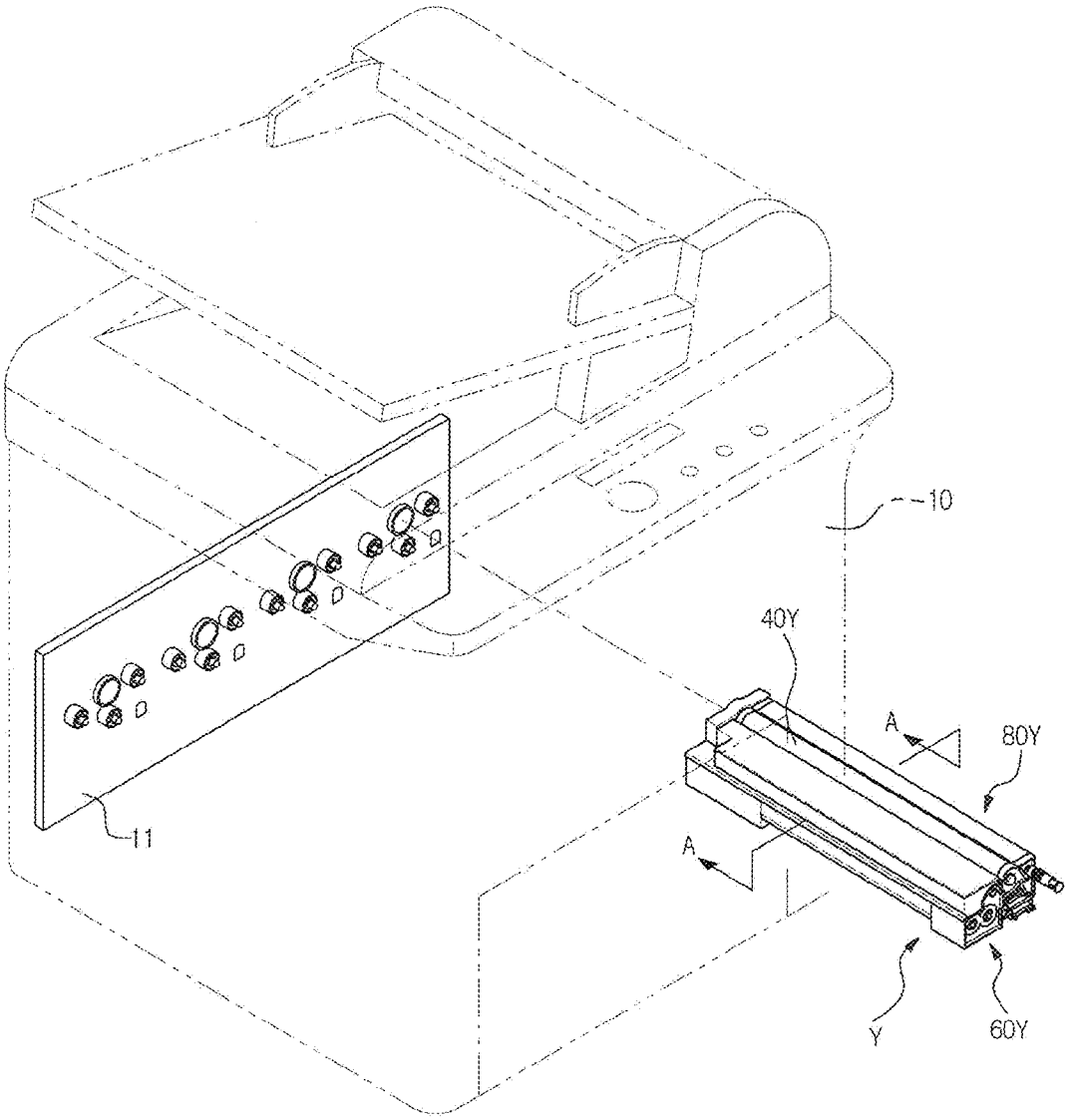
FIG. 2 is a perspective view of a developing unit assembly in accordance with an embodiment of the present disclosure.
Figure 3:
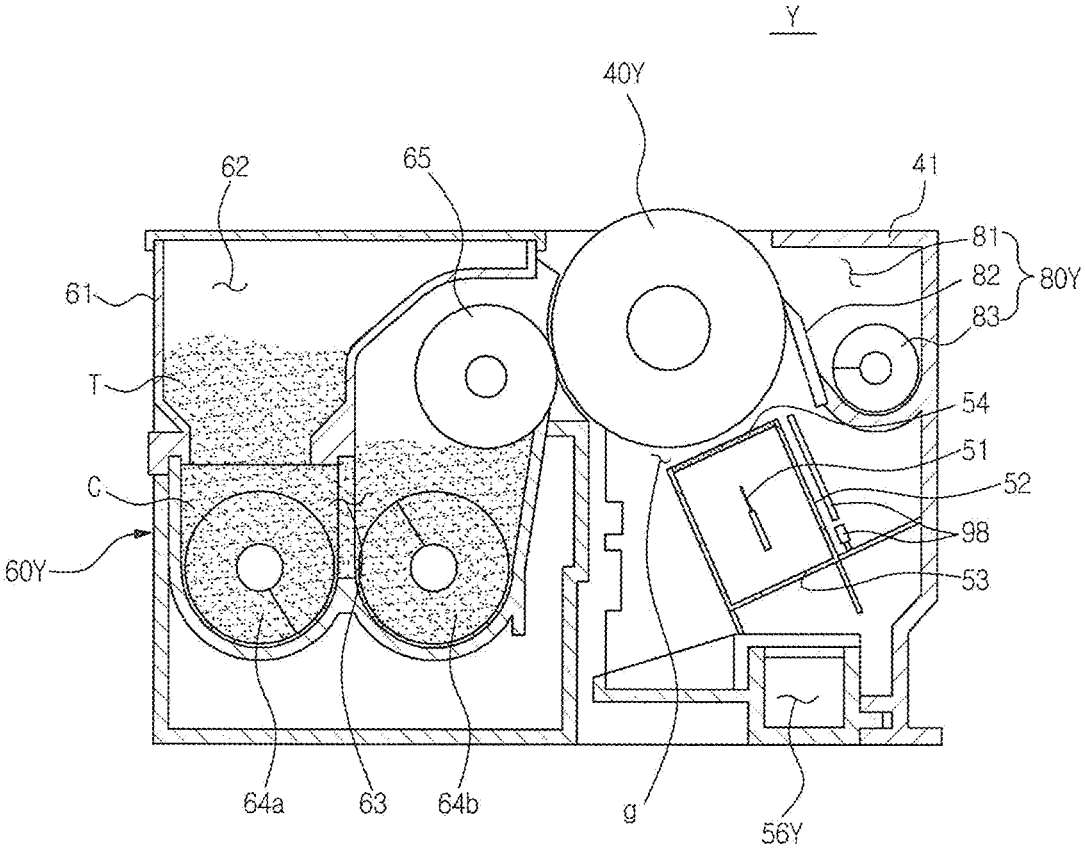
FIG. 3 is a cross-sectional view, taken along the line A-A of FIG. 2 for purposes of illustration of the internal configuration of the developing unit assembly in accordance with an embodiment of the present disclosure.
Figure 4:
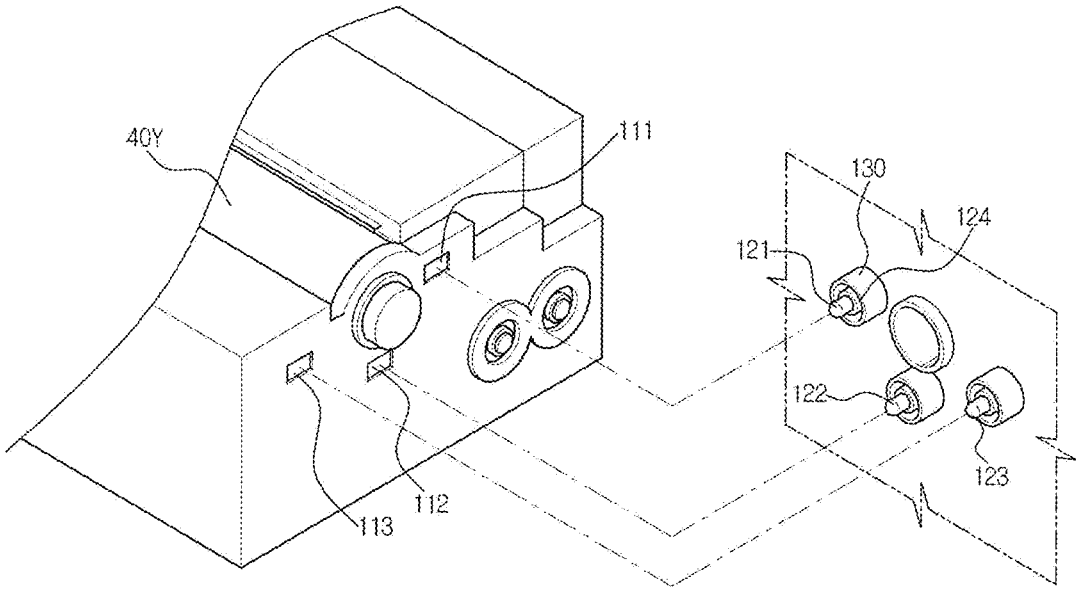
FIG. 4 is illustrative of an electrical connection structure between a main body and the developing unit assembly in accordance with an embodiment of the present disclosure.

FIG. 2 is a perspective view of a developing unit assembly in accordance with an embodiment of the present disclosure. FIG. 3 is a cross-sectional view, taken along the line A-A of FIG. 2 for purposes of illustrating the internal configuration of the developing unit assembly in accordance with an embodiment of the present disclosure. FIG. 4 illustrates an electrical connection structure between the main body and the developing unit assembly in accordance with an embodiment of the present disclosure.

Referring to FIGS. 2 and 3, the image forming apparatus 1 in accordance with an embodiment may include a developing unit assembly Y that may include the photoconductor 40Y, the developer supply unit 60Y, the waste developer removal unit 80Y and the charging device 50Y. The developing unit assembly Y may be detachably received in the main body so that the developing unit assembly Y may be removed from the main body for the purposes of replenishing the developer in the developing unit assembly Y or of replacement of a component of the developing unit assembly Y, for example. For purposes of illustrational convenience, hereinafter, the developing unit assembly Y, which includes the photoconductor 40Y, and which stores the yellow developer for developing a yellow visible image, will be described. However, unless specially stated otherwise, the following descriptions may be applied to the other developing unit assemblies K, C, and M (with reference to FIG. 1) to respectively store developers of different colors.

The photoconductor 40Y is rotatably installed in a photoconductor housing 41.

The developer supply unit 60Y includes a case 61 provided with a developer reception chamber 62 and an agitation chamber 63 formed therein, feeding members 64*a* and 64*b* received in the agitation chamber 63, and a developing device 65 to supply the developer T in the agitation chamber 63 to the photoconductor 40Y. Voltage of an AC 1 kV and a DC 600V is applied to the developing device 65, and the developer is fed to the photoconductor 40Y due to a potential difference.

The developer T in the developer reception chamber 62 is supplied to the agitation chamber 63, and then is agitated by the two feeding members 64*a* and 64*b*. Here, the developer T rubs against carriers C and is electrically charged, and the electrically charged developer T is attached to the photoconductor 40Y via the developing device 65 due to static electricity and thus forms a visible image on the photoconductor 40Y.

The waste developer withdrawal unit 80Y includes a cleaning blade 82 to scrape the waste developer remaining on the photoconductor 40Y to withdraw the waste developer, a withdrawal chamber 81 provided in the photoconductor housing 41 to store the withdrawn waste developer, and an agitation member 83 to agitate the waste developer stored in the withdrawal chamber 81.

The charging device 50Y serves to charge the photoconductor 40Y, from which static electricity is removed by an electrostatic removing device 98, with a designated electric potential, and includes a discharge pin 51, a shield 52 surrounding the discharge pin 51, and a screen 54 installed at an opening of the shield 52 adjacent to the photoconductor 40Y. In this embodiment, voltage of 8 kV is applied to the discharge pin 51, and voltage of 800V is applied to the shield 52.

As shown in FIG. 4, the developing unit assembly Y has contact points 111, 112, and 113 respectively connected to the developing device 65 and the discharge pin 51 and the shield of the charging device 50Y. The contact points 111, 112, and 113 of the developing unit assembly Y are electrically connected with terminals 121, 122, and 123 provided on an inner plate 11.

The image forming apparatus of this embodiment includes a surface distance extension part 130 surrounding the terminal 111 to extend a surface distance with an adjacent conductor. A guide 124 may be provided for guiding the movement of the terminal 111 such that the terminal 111 moves forward and backward. While, for purposes of illustration, one terminal, namely, the terminal 121 connected with the contact point 111, which is in turn connected to the developing device 65, will be described hereinafter, it should be understood that, unless expressly stated otherwise, the following descriptions may be applied to the other terminals and contact points.

The surface distance extension part 130 in accordance with an embodiment may be provided as a wall protruding from the inner plate 11 that surrounds the terminal 121, and may formed integrally with the inner plate 11. The inner plate 11 may made of a non-conductive material such as, for example, acrylonitrile butadiene styrene (ABS). Alternatively, the surface distance extension part 130 may be formed separately from the inner plate 11, and may subsequently be connected to the inner plate 11. The surface distance extension part 130 may be made of other non-conductive materials in addition to ABS.

With such configuration described above, according to an aspect of the present disclosure, it may be possible to realize an improved electrical shielding between a terminal and another conductor adjacent to the terminal, for example, another terminal, of an image forming apparatus. That is, even when a portion of the current supplied to the terminal were to flow along the surface of the inner plate, a surface distance between such terminal and the adjacent conductor(s) that may be sufficient in maintaining a safe level of electrical shielding between the terminal and the adjacent conductor(s) can still be secured. Even when plural terminals, to which high voltages, for example, 1 kV is applied, are arranged in relatively close proximity with one another, for example, as with the case of the image forming apparatus according to one or more embodiment herein described, a sufficient electrical shielding between the terminals may be realized. Accordingly, a reduction in the distances between terminals or between a terminal and a conductor that in turn makes possible a reduction in the size of the image forming apparatus can be achieved without significantly compromising the electrical shielding of the electrical connections therein.

While, for purposes of illustration, the terminals 121, 122 and 123 as examples of electrical connection features are described above, it should be understood that the number, shapes and/or the configuration of the electrical connection features are not intended to be limited to such specific examples. For example, in an alternative embodiment, the terminals may be in the form of flat surfaces or plates rather than a protrusion.

Figure 5A:
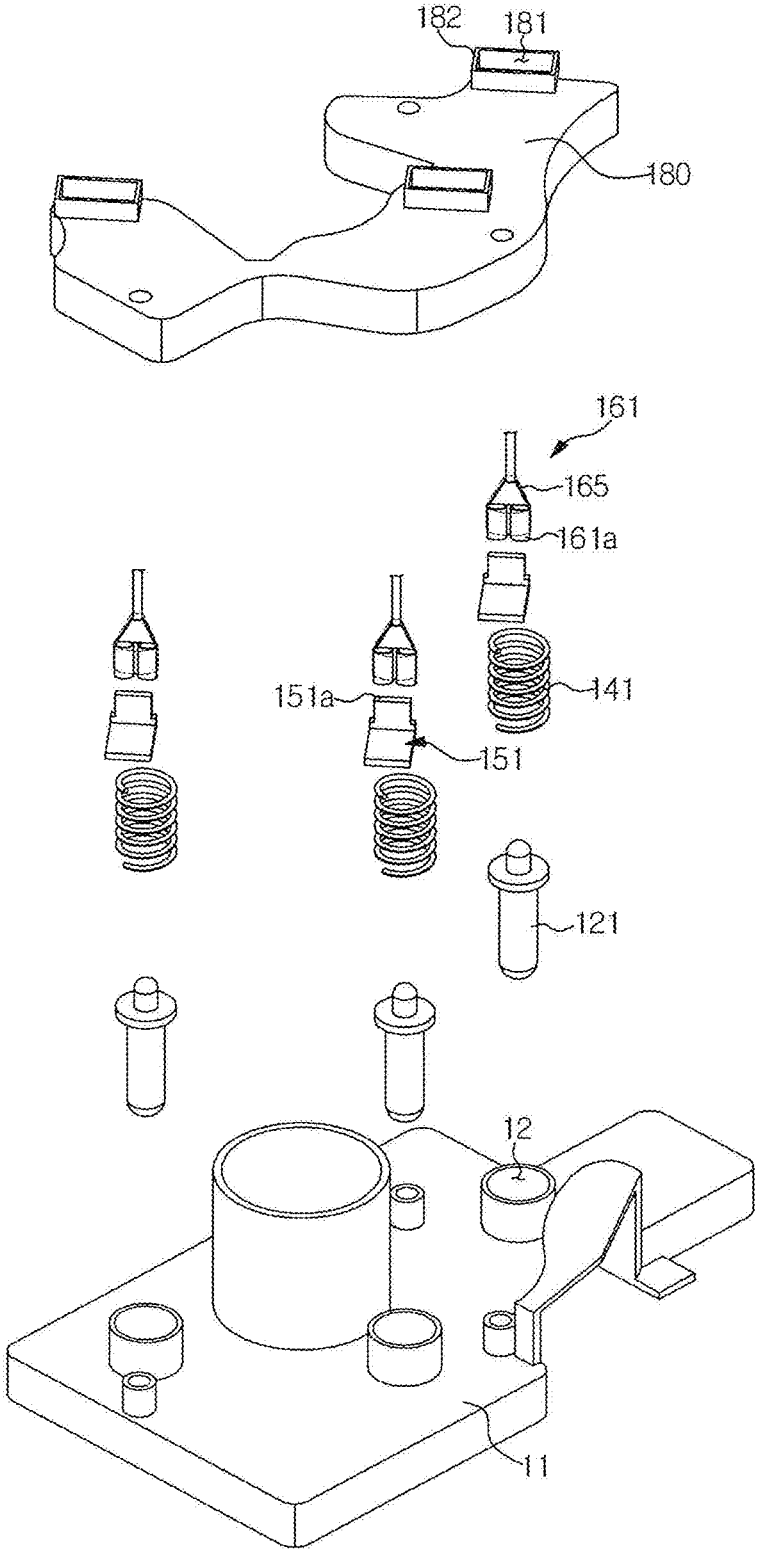
FIG. 5A is an exploded perspective view illustrating a power supply unit for the developing unit assembly in accordance with an embodiment of the present disclosure.
Figure 5B:
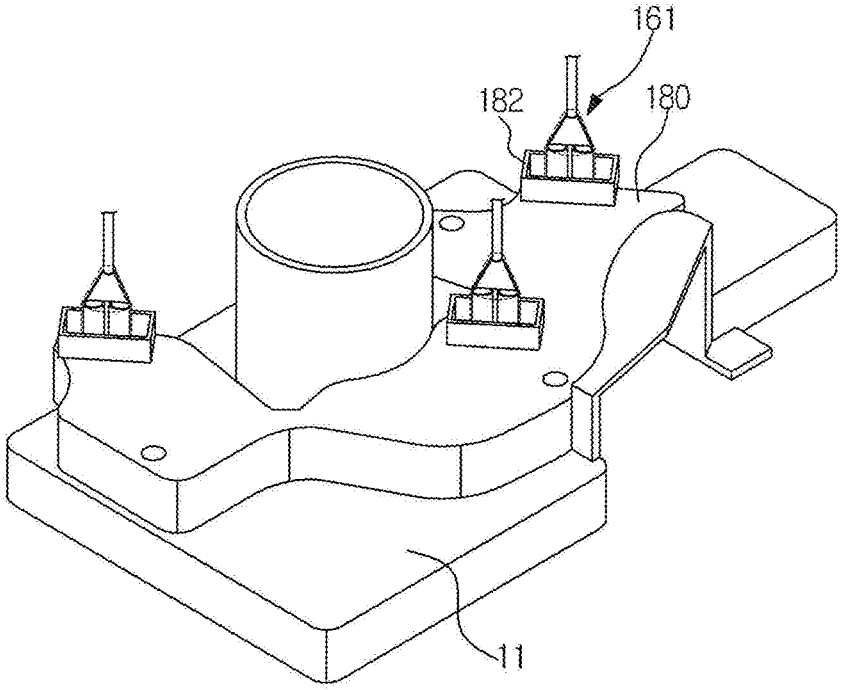
FIG. 5B is an assembled perspective view of the power supply unit for the developing unit assembly in accordance with the embodiment of the present disclosure.
Figure 5C:
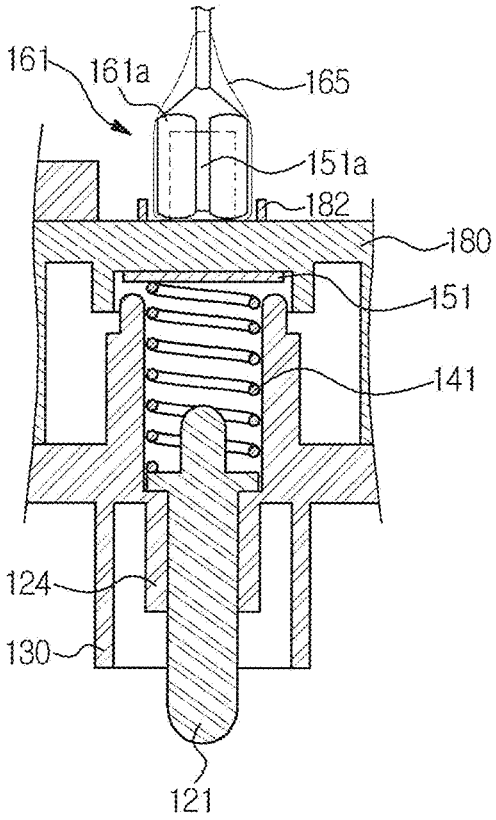
FIG. 5C is a partial-sectional view of the power supply unit for the developing unit assembly in accordance with an embodiment of the present disclosure.

FIG. 5A is an exploded perspective view of a power supply unit for the developing unit assembly in accordance with an embodiment of the present disclosure. FIGS. 5B and 5C are an assembled perspective view and a partial-sectional view, respectively, of the power supply unit for the developing unit assembly of FIG. 5A.

Referring to FIGS. 5A to 5C, an image forming apparatus in accordance with an embodiment may further include elastic members 141 arranged to elastically support the terminals 121, 122 and 123, connection plates 151 arranged to be in electrical contact with the elastic members 141, a protection board 180 for supporting the connection plates 151 in such a manner maintaining the electrical contact between the elastic members 141 and the connection plates 151. Each of the terminals 121, 122 and 123 and the respective associated one of the elastic members 141 may be received into the corresponding one of the installation holes 12 provided on the inner plate 11 whereas the protection plate 180 may support ends of the connection plates 151 such that the respective corresponding ones of elastic members 141 and the terminals 121 are held in place and in electrical contact with each other. The power supplied to the connecters 161 may transmitted to the terminals 121, 122 and 123 through the connection plates 151 and the elastic members 141.

Each of the connection plates 151 may be provided with a first insertion part 151*a* protruding therefrom. Each of the connectors 161 may provided with a second insertion part 161*a* formed in a shape corresponding to the shape of the first insertion part 151*a*, e.g., in the above example, a recess of a certain shape into which the first insertion part 151*a* may be received. With such configuration, the first insertion part 151*a* of the connection plate 151 and the second insertion part 161*a* of the connector 161 can be coupled with, and thus in electrically connected with, each other by the insertion one into the other.

According to an embodiment, each of the connectors 161 may be provided with an insulating cap 165 that is arranged slidably so as to be capable of slipping over the first insertion part 151*a* and the second insertion part 161*a* and to thereby serve as a protective cover. The insulating cap 165 may further assist in maintaining the first insertion part 151*a* and the second insertion part 161*a* in their engaged or coupled position. Additionally, the insulating cap 165 may also serve to electrically shield the first insertion part 151*a* and the second insertion part 161*a*.

According to an aspect of the present disclosure, with such configuration of the image forming apparatus in accordance with one or more embodiment above described, the coupling together the connectors 161 and the connection plates 151 may be carried out with a simple insertion operation without the need for any specialized tool, and thus may require a shorter assembly time. The insulating caps provided according to an embodiment may provide a further improvement in the electrical shielding between the connectors 161 and the terminals.

While a particular example of each of the connection plates 151 and the connectors 161 is described above for illustrative purposes, the shapes and the configuration of the connection plates 151 and the connectors 161 need not be limited to that shown in the particular example. Many alternative shapes and configurations are possible. For example, in an alternative embodiment, the first insertion parts 151*a* of the connection plates 151 may be provided as recesses capable of receiving therein the second insertion parts 161*a* of the connectors 161, which may be provided as protrusions.

Exposure holes 181 may be formed on the protection plate 180 such that the first insertion parts 151*a* of the connection plates 151 may be received therein to be exposed to the outside therethrough. Additional surface distance extension parts 182 may further be formed around the exposure holes 181. The additional surface distance extension parts 182 may provide further improvement in the electrical shielding for the contact points, e.g., the first insertion parts 151*a* in this example, by providing an extended surface distance between adjacent electrical conductors.

Figure 6:
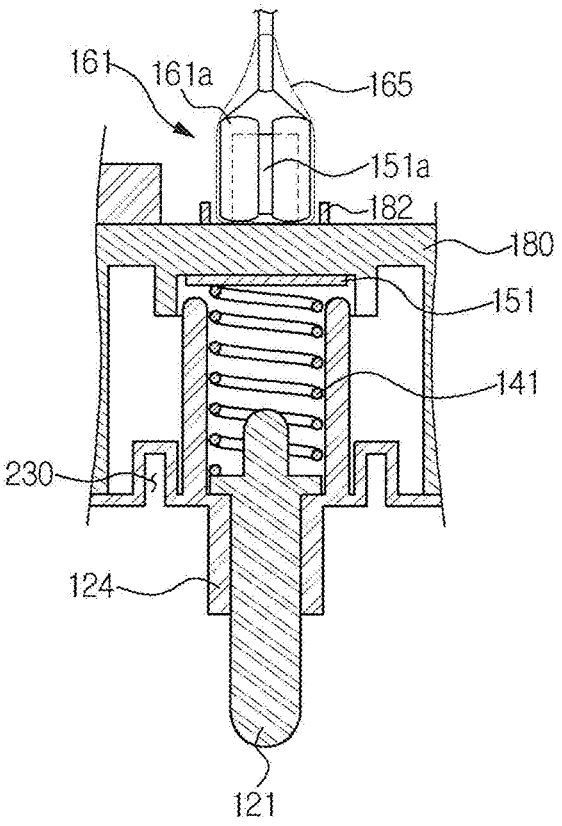
FIG. 6 is a cross-sectional view illustrating a surface distance extension part in accordance with an embodiment of the present disclosure.

As previously noted, the shape of the surface distance extension part need not be limited to those described and shown in connection to the previously described embodiments. For example, shown in FIG. 6 is a surface distance extension part in accordance with another embodiment of the present disclosure. The features depicted in FIG. 6 that may be substantially the same as those of embodiments previously described are denoted by the same reference numerals, and will not be described repeatedly as unnecessary and for the sake of brevity.

Referring to FIG. 6, a surface distance extension part 230 according to an alternative embodiment may be provided as a groove formed on the inner plate 11 that surrounds the terminal 121.

Figure 7:
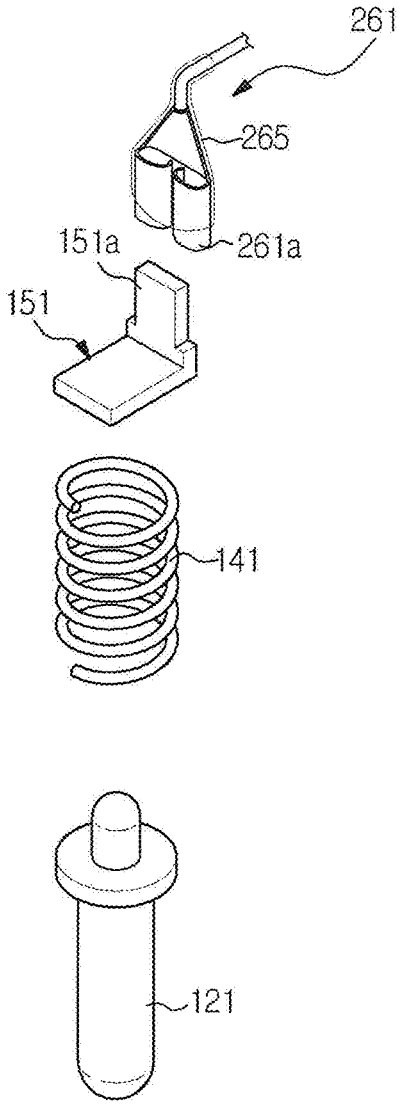
FIG. 7 is a perspective view illustrating a connector in accordance with an embodiment of the present disclosure.

Likewise, many other features and/or components may have various other shapes, configurations and/or arrangements than those particularly described above. For example, shown in FIG. 7 is connector in accordance with another alternative embodiment of the present disclosure. As shown in FIG. 7, according to an embodiment, a second insertion part 261*a* of a connector 261 may be bent near the electrical wire 262 at approximately 90 degrees. An insulating cap 265 may be arranged to encapsulate or otherwise cover the second insertion part 261*a* including the bent portion thereof.

Many aspects of the embodiments of the present disclosure described above may be modified in various manner. For example, while the developing unit assembly is described above as including the photoconductor, in alternative embodiments, the developing unit assembly need not include the photoconductor, which may instead be mounted on the main body separably from the developing unit assembly.

It is also worth noting that while the developing unit assembly is referenced as but one example of detachable members of devices that may be detachably supported in the main body, and that requires electrical connection to the main body, one or more aspects of the present disclosure may be applicable to any such detachable devices or members of the image forming apparatus in addition to the developing unit assembly.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a main body defining an overall external appearance of the image forming apparatus;

one or more developing unit assemblies detachably received in the main body, each of the one or more developing unit assemblies including a photoconductor, a charging device and a developer supply unit, the charging device being arranged adjacent the photoconductor and being configured to charge the photoconductor to an electrical potential, the developer supply unit being configured to supply developer to the photoconductor;

a plurality of terminals provided on a support surface within the main body, the plurality of terminals being arranged to be electrically connected to a plurality of electrical contacts of each of the one or more developing unit assemblies received in the main body; and a surface distance extension part having a surface that surrounds at least a portion of any one of the plurality of terminals so as to extend a surface distance between at least two adjacent ones of the plurality of terminals, wherein the surface distance extension part is formed integrally with the support surface, the surface distance extension part and the support surface being formed of the same material.

2. The image forming apparatus according to claim 1, wherein the surface distance extension part comprises one of a protrusion protruding from the support surface and a depression into the support surface.

3. The image forming apparatus according to claim 1, wherein the surface distance extension part is made of a non-conductive material.

4. The image forming apparatus according to claim 1, further comprising:

a plurality of connection plates each in electrical connection with a respective corresponding one of the plurality of terminals, each of the plurality of connection plates having a first insertion portion at one side thereof; and a plurality of connectors each having a second insertion portion capable of being coupled to the first insertion part of a respective corresponding one of the plurality of connection plates.

5. The image forming apparatus according to claim 4, wherein the first insertion portion comprises a protrusion, the second insertion portion comprising a recess into which the first insertion portion is received.

6. The image forming apparatus according to claim 4, further comprising:

a plurality of insulating caps each arranged over, and to thereby protect, the first insertion part and the second insertion part, which are coupled to each other, associated with a respective corresponding pair of the plurality of connection plates and the plurality of connectors.

7. The image forming apparatus according to claim 6, wherein each of the plurality of insulating caps is arranged slidably on a respective associated one of the plurality of connectors.

8. An image forming apparatus having a support plate on which contact points are arranged for applying electrical power therethrough, comprising:

a surface distance extension part arranged on the support plate in such a manner to surround a first one of the contact points so as to extend a surface distance between the first one of the contact points and a second one of the contact points adjacent the first one of the contact points, wherein the surface distance extension part is formed integrally with the support plate, the surface distance extension part and the support surface being formed of the same material.

9. The image forming apparatus according to claim 8, wherein the surface distance extension part comprises a wall protruding from the support plate.

10. The image forming apparatus according to claim 8, wherein the surface distance extension part comprises one or more grooves formed into the support plate.

11. The image forming apparatus according to claim 8, wherein the surface distance extension part is formed of a non-conductive material.

12. The image forming apparatus according to claim 8, further comprising:

connectors each electrically connected with a respective corresponding one of the contact points, wherein the contact points and the connectors each comprise one of a protrusion and a recess into which the protrusion is received.

13. The image forming apparatus according to claim 12, further comprising:

an insulating cap arranged to cover, and to thereby protect, a coupled pair of contact point and connector.

14. The image forming apparatus according to claim 13, wherein the insulating cap is arranged slidably on at least one of the connectors.

15. An image forming apparatus, comprising:

a main body defining an external appearance of the image forming apparatus;

developing unit assemblies each including a photoconductor, a charging device, a developer reception chamber and a developing device, the charging device being configured to charge the photoconductor to an electrical potential, the developer reception chamber being configured to store therein developer to be supplied to the photoconductor, the developing device being configured to supply the developer stored in the developer reception chamber to the photoconductor;

a plurality of contact points provided on each of the developing unit assemblies through which to supply electrical power to at least one of the charging device and the developing device;

a plurality of terminals provided on a support plate within the main body, each of the plurality of terminals being configured to be connected with a respective corresponding one of the plurality of contact points provided on each of the developing unit assemblies; and a surface distance extension part arranged to surround a first one of the plurality of terminals so as to extend a surface distance between the first one of the plurality of terminals and a second one of the plurality of terminals adjacent the first one of the plurality of terminals, wherein the surface distance extension part is formed integrally with the support plate, the surface distance extension part and the support surface being formed of the same material.

16. The image forming apparatus according to claim 15, wherein the surface distance extension part comprises a wall protruding from the support plate.

17. The image forming apparatus according to claim 15, wherein the surface distance extension part comprised a groove formed on the support plate.

18. An image forming apparatus, comprising:

a support member having arranged thereon a plurality of electrical contacts, two adjacent ones of the plurality of electrical contacts being space apart from each other by a distance; and a surface distance extension arranged on the support member to surround at least one of the two adjacent ones of the plurality of electrical contacts such that a surface distance measured along surfaces of the support member and the surface distance extension from one the two adjacent ones of the plurality of electrical contacts to the other is greater than the distance by which the two adjacent ones of the plurality of electrical contacts are spaced apart, wherein the surface distance extension is formed integrally with the support member, the surface distance extension part and the support surface being formed of the same material.

19. An image forming apparatus, comprising:

a first support member having arranged thereon a first plurality of electrical contacts, two adjacent ones of the first plurality of electrical contacts being space apart from each other by a first distance;

a surface distance extension arranged on the first support member to surround at least one of the two adjacent ones of the first plurality of electrical contacts such that a first surface distance measured along surfaces of the first support member and the surface distance extension from one the two adjacent ones of the first plurality of electrical contacts to the other is greater than the first distance by which the two adjacent ones of the first plurality of electrical contacts are spaced apart; and a second support member having a second plurality of electrical contacts arranged such that each of the second plurality of electrical contacts comes into contact with a respective corresponding one of the first plurality of electrical contacts, a second surface distance measure along a surface of the second support member between two adjacent ones of the second plurality of electrical contacts that correspond respectively to the two adjacent ones of the first plurality of electrical contacts being smaller than the first surface distance.

20. The image forming apparatus of claim 19, wherein the second support member being detachable from the image forming apparatus.

* * * * *

UNITED STATES PATENT AND TRADEMARK OFFICE

CERTIFICATE OF CORRECTION

PATENT NO. : 8,744,300 B2
APPLICATION NO. : 12/624114
DATED : June 3, 2014
INVENTOR(S) : Lee It is certified that error appears in the above-identified patent and that said Letters Patent is hereby corrected as shown below:

In the Claim

Column 12, Line 6, Claim 19, delete "one the two" and insert -- one of the two --, therefor.

Signed and Sealed this
Thirtieth Day of September, 2014

Michelle K. Lee

Michelle K. Lee
*Deputy Director of the United States Patent and Trademark Office*